US005960633A

United States Patent [19]

Limbach

[11] Patent Number: 5,960,633

[45] Date of Patent: Oct. 5, 1999

[54] APPARATUS AND METHOD FOR TRANSPORTING HIGH VALUE LIQUIFIED LOW BOILING GASES

[76] Inventor: John N. Limbach, 823 Hedwig Way, Houston, Tex. 77024

[21] Appl. No.: 09/079,036

[22] Filed: May 14, 1998

[51] Int. Cl.[6] ..... F17C 1/00

[52] U.S. Cl. ..... 62/45.1; 62/49.2

[58] Field of Search ..... 62/45.1, 49.2

[56] References Cited

U.S. PATENT DOCUMENTS

| | | | |
|---|---|---|---|
| 3,762,175 | 10/1973 | Jones | 62/45.1 |
| 4,399,659 | 8/1983 | Strigl | 62/50.2 |
| 5,005,362 | 4/1991 | Weltmer, Jr. et al. | 62/45.1 |
| 5,456,084 | 10/1995 | Lee | 62/51.1 |
| 5,697,220 | 12/1997 | Pierce et al. | 62/45.1 |

FOREIGN PATENT DOCUMENTS 7-151300 6/1995 Japan .

*Primary Examiner*—Ronald Capossela
*Attorney, Agent, or Firm*—Browning Bushman

[57] ABSTRACT

An apparatus and method for shipping a high value liquified gas product using a low value liquified gas product as a cooling medium, the low value liquified gas product having a boiling point lower than the high value liquified gas product, the high value liquified gas product being contained in a first vessel, the low value liquified gas product being contained in a second vessel, which is contained within the first vessel, the second vessel being in heat exchange relationship with the low value liquified product contained in the first vessel whereby heat conducted to and absorbed by the high value liquified product is expended as heat of vaporization of the low value liquified product, thereby maintaining the volume of liquified high value product substantially constant and preventing expensive losses through vaporization thereof.

18 Claims, 1 Drawing Sheet

APPARATUS AND METHOD FOR TRANSPORTING HIGH VALUE LIQUIFIED LOW BOILING GASES

BACKGROUND OF THE INVENTION

1. Field of the Invention

The present invention relates to an apparatus and method for the shipping and storage of liquified gases. More particularly, the present invention relates to an apparatus and method for the shipping and storage of liquified gases of high value, such as, for example, liquid argon.

2. Description of the Prior Art

Argon is widely used in the manufacture of computer chips and in numerous other industrial and manufacturing processes where an inert atmosphere is needed. Liquified argon is obtained by fractionation in the liquification of air. Because argon constitutes less than 1.5% by weight of air, liquified argon is quite expensive compared, for example, to liquified air itself or liquified nitrogen. Indeed, liquified nitrogen, on a per unit basis, is about 10% of the cost of liquified argon.

Because the cryogenic processes used to liquify air and ultimately obtain liquified argon are sophisticated and capital-intensive, users of even large amounts of liquified argon rarely have such cryogenic facilities available. Accordingly, the liquified argon is commonly shipped in insulated tank trucks or railroad tank cars from the cryogenic producing facility to the users. The shipping of liquified argon invariably leads to considerable product loss. Liquid argon has a very low heat capacity. Accordingly, any external heat absorbed by the liquified argon causes the latter to heat up quickly, expand, and vaporize. This expansion/vaporization process increases the pressure on the interior of the shipping vessel, e.g., tank truck, until argon gas is allowed to escape through a suitable pressure relief valve (vent). For this reason, tank cars and other shipping vessels leave a dead or vapor space volume of about 10% of the volume of the shipping vessel to accommodate the vaporization/expansion.

Because of its value, every effort is made to minimize losses of liquified argon by vaporization. This obviously requires shipping vessels with elaborate insulation to minimize heat transfer between ambient surroundings and the liquified argon. However, even with the best insulation methods presently in use, it is not uncommon, particularly when liquified argon is shipped in rail cars over substantial distances, for there to be an approximate 10% by weight loss of the liquified argon due to vaporization/expansion and subsequent venting.

At atmospheric pressure, liquified nitrogen boils at about −196° C. whereas liquified argon boils at about −186° C. It is known to take advantage of this boiling point differential between liquified argon and liquified nitrogen to minimize losses of liquified argon. See, for example, Japanese Patent Publication No. 298444, incorporated herein by reference for all purposes. It is also well known to vent storage vessels and the like containing a volatile, liquified product to maintain a desired temperature from cooling due to heat of vaporization of the liquified product.

It would be economically quite advantageous if there were available an apparatus and method that could be readily retrofitted into existing shipping vessels, i.e., tank trucks or railroad tank cars, which would substantially eliminate any loss of liquified argon.

SUMMARY OF THE INVENTION

It is therefore an object of the present invention to provide an apparatus for shipping a high value liquified gas product, such as argon, using a low value liquified gas product, such as nitrogen.

Another object of the present invention is to provide a method for transporting a high value liquified gas product, such as liquified argon, using a liquified gas product, such as liquified nitrogen, having a lower value relative to the high value product.

Still another object of the present invention is to provide a system for transporting a high value liquified gas product, such as argon, which can be readily retrofitted to existing shipping vessels, such as railroad tank cars or tank trucks.

The above and other objects of the present invention will become apparent from the description, the drawings, and the claims.

In one embodiment, the present invention provides a containment apparatus for the shipping of a high value liquified gas product using a liquified gas product having a lower value relative to said high value product. The containment apparatus of the present invention includes a first housing defining a first chamber for a high value liquified gas product having a boiling point lower than about −170° C. and a second housing defining a second chamber for the low value liquified gas product having a boiling point lower than the boiling point of the high value product, the second housing being disposed within the first housing and being at least partially in heat exchange relationship with the high value liquified product. The containment apparatus further includes a first inlet for introducing high value product into the first chamber and a second inlet for introducing low value product into the second chamber. There is also provided a vent for releasing vaporized low value product from the second chamber in response to an increase in temperature in the high value product.

According to another aspect of the present invention, there is provided a system for transporting a high value liquified gas product using a liquified gas product having a low value relative to said high value liquified product, the system including a first vessel defining a first chamber, the first chamber having a majority of its volume occupied by a high value liquified gas product having a boiling point lower than about −170° C. and a second vessel defining a second chamber for containing a low value liquified gas product, the low value product having a boiling point lower than the boiling point of the high value product, the second chamber being at least partially in heat exchange relationship with the high value liquified product in the first chamber. A vent is provided for releasing vaporized low value liquified product in response to an increase in temperature of the high value liquified product. The second chamber is sized to contain an amount of the low value product to permit sufficient vaporization and venting of the low value product so as to maintain a substantially constant volume of the high value liquified product for a predetermined period of time.

In still another embodiment of the present invention, there is provided a method of transporting a high value liquified gas product using a liquified gas product having a lower value relative to the high value product. The method includes providing a transportable containment apparatus comprising a first housing defining a first chamber for holding a high value liquified gas product having a boiling point of lower than about −170° C. and a second vessel defining a second chamber for containing a low value liquified product having a boiling point lower than the boiling point of the high value product; and introducing high value product into the first chamber to a desired, filled amount, the second chamber being at least partially in heat exchange relationship with the high value liquified product in the first chamber. The method further includes releasing vaporized low value liquified product in response to an increase in temperature of the high value liquified product and transporting the containment apparatus from a first location to a second location.

DESCRIPTION OF THE PREFERRED EMBODIMENT

While the present invention will be described in particularity with respect to liquified argon as a "high value liquified gas product" or "high value product," and nitrogen as a "low value liquified gas product" or "low value product," it is to be understood that the invention is not so limited. In general, the invention can be used to prevent, during shipping, the loss of high value liquified gases having a boiling point of less than about −170° C. and, accordingly, includes gases such as neon, helium, etc. The process particularly relates to liquified inert gases, liquified nitrogen, liquified oxygen, and liquified air. Thus, it can be broadly stated that the invention is directed to gases obtained by what are commonly referred to as cryogenic processes.

Figure 1:
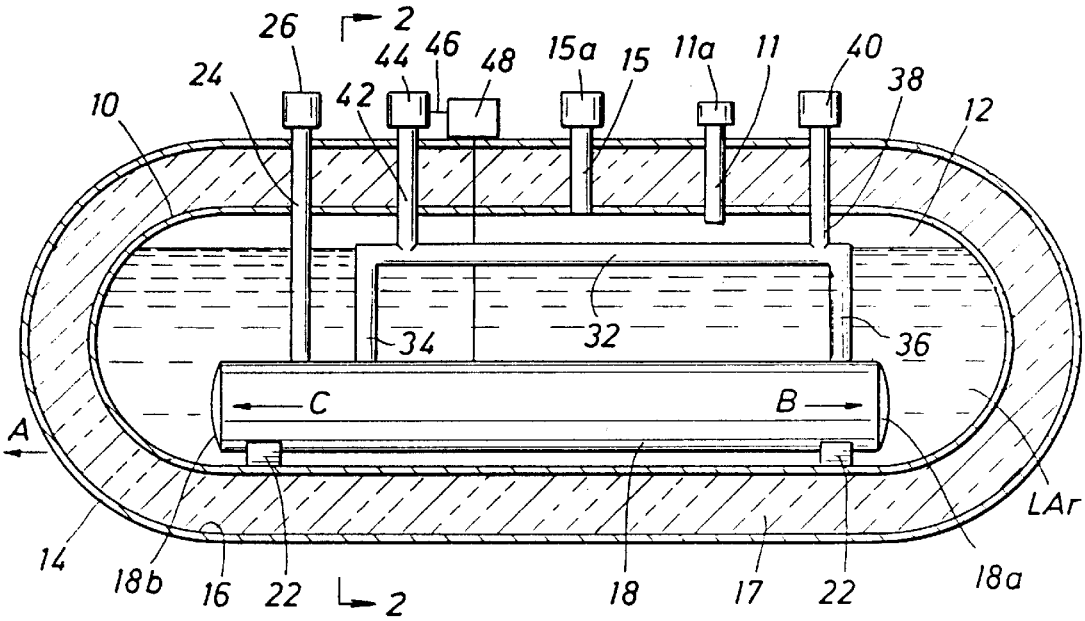
FIG. 1 is an elevational view, partly in section, showing an apparatus according to the present invention.

With reference to FIG. 1, there is shown a generally cylindrical pressure vessel 10 defining an enclosed chamber 12, pressure vessel 10 being constructed of steel or some other high strength material that can withstand vacuum and elevated pressures. Pressure vessel 10 is encapsulated or surrounded by a jacket 14, also generally made of steel or some other high strength material, jacket 14 and pressure vessel 10 having generally the same shape as pressure vessel 10 but being smaller than jacket 14 to thereby form an encircling insulation space 16 between jacket 14 and pressure vessel 10. As is well known to those skilled in the art, in addition to being under vacuum, insulation space 16 is filled with a suitable insulating material 17 to minimize heat transfer from the ambient, i.e., external of jacket 14, to pressure vessel 10. Pressure vessel 10 is designed to hold or contain a liquified high value gas, e.g., liquified argon, indicated as LAR, which is introduced into chamber 12 via an inlet comprising a pipe or tube 11 that extends through jacket 14 and is in open communication with chamber 12, pipe or tube 11 being provided with a suitable valve 11*a* so as to permit filling of chamber 12 with the desired amount of high value liquified gas product, LAR with a pressure release system comprising a pipe or tube 15 that extends through jacket 14 and pressure vessel 10 and is in open communication with chamber 12, pipe or tube 15 being attached to a suitable pressure relief valve 15*a* to relieve any excessive pressure buildup in chamber 12.

Disposed wholly interiorly of pressure vessel 10 is a second pressure vessel 18 that, like pressure vessel 10, is constructed of steel or some other high strength material but is at least in part constructed of a material having high thermal conductivity, such as a metal, including alloys. Pressure vessel 18 defines a chamber 20 and is rigidly secured to the interior of pressure vessel 10 by means of legs 22 that extend between and are attached to both pressure vessels 10 and 18. Pressure vessel 18 is provided with an inlet comprised of a suitable pipe or tube 24 and a valve indicated generally as 26 to introduce low value liquified gas product indicated as $LN_2$ (see FIG. 2) into pressure vessel 18.

The embodiment shown in FIG. 1 is designed as a containment vessel such as would be used in a tank truck or a railway tank car. It will be understood that in either case, movement of the tank truck or tank car in a forward direction, arbitrarily indicated by arrow A, would cause the low value liquified product $LN_2$ in pressure vessel 18 to move in the direction of arrow B and essentially pile up at end 18*a* of pressure vessel 18. Likewise, if the tank car or railcar is coming to a stop, inertial forces would cause a reverse movement and piling of liquified product $LN_2$ toward end 18*b* of pressure vessel 18. Accordingly, to ensure that there will always be a vapor space above pressure vessel 18, pressure vessel 18 is provided with a piping system comprised of a cross pipe 32 interconnected to and in open communication with first and second stand pipes 34 and 36, which are each in open communication with chamber 20 in pressure vessel 18. Connected generally at one end of cross pipe 32 and in open communication therewith is a tube or pipe 38 on which is mounted pressure relief valve 40 of a suitable type to relieve excessive pressure that might build up in pressure vessel 18 and create a safety hazard. Also connected to cross pipe 32 is another pipe or tube 42 that is in open communication with cross pipe 32 and is fitted with a control valve 44, which can be selectively opened and closed to relieve vaporized low value product LN contained in pressure vessel 18.

As indicated by line 46, control valve 44 is operatively connected to a controller 48, which in turn is operatively connected, as indicated by line 50, to a temperature sensor 52 that is disposed in the liquified high value product LAR contained in pressure vessel 10. As is well known to those skilled in the art, temperature sensor 52 can take a variety of forms. Likewise, controller 48 is of conventional design and is designed to respond to temperature changes detected by sensor 52 and to selectively open or close control valve 44 in response to such temperature changes. It will be appreciated that a variety of control systems, control valves, and sensors can be used and that the selection of such is well within the skill of those in the art.

In operation, pressure vessel 18 would be filled with a low value liquified gas product, which, as noted above, in this case is liquified nitrogen. Pressure vessel 10 would be filled, to the desired level, with high value liquified gas product, which in this case is argon. In the usual case, the vessel containing the low value product, i.e., vessel 18, would initially be substantially completely filled with the liquified low value product. However, in the case of the high value liquified product, because of heat absorption from rapid expansion and vaporization, a vapor space must be left in chamber 12, i.e., pressure vessel 10 cannot be completely filled with the liquified argon. Generally speaking, about 10% of the volume of chamber 12 would initially be left unfilled with liquified argon. In shipping, heat transferred from the ambient air or other environments exterior of shell 14 will eventually be absorbed by the liquified argon LAR, which would typically result in vaporization of some of the liquified argon, increasing the pressure inside pressure vessel 10 to a point where vaporized argon begins to escape through pipe 15 and pressure relief valve 15*a*. However, because of the present invention, such vaporization and resultant loss of liquid argon, LAR is avoided. As heat absorption into the liquid argon takes place, as described above, temperature sensor 52 detects the increase in temperature in the liquified argon and transmits a suitable signal to controller 44 indicative of the temperature increase in the liquid argon. At a predetermined increase in temperature in the liquid argon, which can be easily programmed into controller 48, controller 48 will send an appropriate signal to control valve 44, causing control valve 44 to open, allowing vaporized liquid nitrogen to escape or vent from pressure vessel 18 through pipe 42 and valve 44. As the low value liquified nitrogen vaporizes, the heat of vaporization absorbs heat from the liquid argon, thereby cooling the liquid argon in pressure vessel 10. Accordingly, any heat that was or is being transferred through shell 14 and into the liquified argon, is removed via the process of using that heat to vaporize the lower boiling nitrogen. Accordingly, the volume of liquid argon in pressure vessel 10 remains substantially constant.

It will be appreciated that since heat is generally continuously being transferred from external of jacket 14 into the liquid argon in pressure vessel 10, some of the low value liquified nitrogen in vessel 18 is more or less continuously being vaporized once the control temperature or pressure of the high value liquified argon is reached. In this regard, it is to be noted that while the invention has been described with the use of a heat sensor 52, a pressure sensor to sense an increase in pressure in the vaporized argon in pressure vessel 10 would serve as well since any increase in temperature in the liquid argon will be reflected as a corresponding increase in pressure in the vaporized argon.

It will also be appreciated that while the system is shown as using a controller 18, and a heat or pressure sensor together with a control valve, to selectively vent or release vaporized low value product from pressure vessel 18, it will be recognized that a much more simplified arrangement could be employed wherein liquified low value product in pressure vessel 18 was allowed to vaporize at atmospheric pressure, or at some other increased pressure, through an orifice, relief valve, or other similar device. Whether done continuously, selectively, at atmospheric pressure or at some increased pressure, it is only necessary that the low value product be allowed to vaporize in response to an increase in temperature or pressure in the high value product such that the high value product is maintained at a temperature that prevents its vaporization such that the volume of liquified high value product remains substantially constant.

Figure 2:
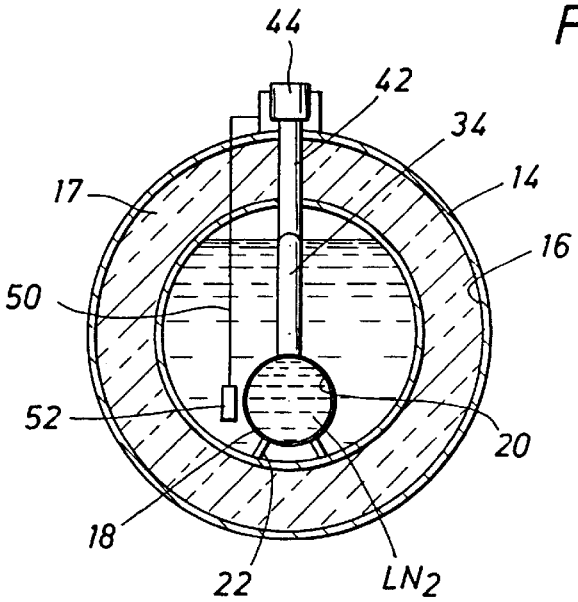
FIG. 2 is a cross-sectional view taken along the lines 2—2 of FIG. 1

In the embodiment shown in FIGS. 1 and 2, pressure vessel 18 is completely immersed in the liquid argon contained in pressure vessel 10. This would be the usual case at the commencement of shipping. Thus, at least a portion of pressure vessel 18, being made of a material having high thermal conductivity, would be in heat exchange relationship with the liquified argon in pressure vessel 10. As a practical matter, the entirety of pressure vessel 18 is made of a material having high thermal conductivity. Accordingly, at the commencement of shipping or when pressure vessel 10 is filled to the desired capacity, the entirety of high pressure vessel 18 is in heat exchange relationship with only liquified argon, i.e., liquified high value product.

Generally speaking, pressure vessel 18 will be sized to contain an amount of liquified low value product sufficient, through vaporization and absorption of heat from liquified high value product, to maintain a substantially constant volume of liquified high value product for a predetermined period of time. In other words, taking into account the time involved in shipping the liquified argon, as well as expected temperature conditions surrounding jacket 14, pressure vessel 18 will be sized to contain an amount of liquified nitrogen that, through vaporization and subsequent heat absorption from the liquified argon, will permit the liquified argon volume to remain substantially constant for that given period of time under those given temperature conditions. It will be appreciated that at times, e.g., longer than expected shipping times, unusually high ambient temperatures, etc., the supply of liquified nitrogen will be exhausted prior to the time the liquid argon is off-loaded at the point of use. The present invention easily obviates that problem since, in such a case, it is only necessary to recharge pressure vessel 18 with additional liquified nitrogen, e.g., from a tank truck or railway tank car containing same.

It will be recognized that the apparatus and method of the present invention possess many advantages. As noted above, liquified nitrogen is produced, together with liquified argon, in the liquification of air. However, liquified nitrogen is much less expensive, i.e., has a much lower value, than liquified argon. Moreover, air liquification plants typically have large excess quantities of nitrogen, and the cost of the marginal liquified nitrogen needed to supply sufficient liquified nitrogen for use in the apparatus and method of the present invention is quite low, being only the cost of liquifying excess gaseous nitrogen already separated and being vented to the atmosphere as excess nitrogen.

Although pressure vessel 18, i.e., the vessel containing the liquified low value gas product, takes up space in vessel 10, i.e., the vessel used to contain the liquified high value product, this is offset by the fact that the space that pressure vessel 18 occupies is roughly equal to a reduced space in vessel 10 needed to accommodate expansion of liquid argon caused by increasing temperature during shipping and the space that the argon occupies that would have been lost during shipping due to such heating. Accordingly, tank trucks, tank cars, or other shipping containers can deliver approximately the same amount of liquified argon, i.e., less vapor space need be left in the vessel holding the liquid argon for vaporization and no liquified argon is lost.

The apparatus and method of the present invention has advantages over and above preventing loss of high value product, e.g., liquified argon. For example, once the liquified argon has been off-loaded at the point of use, the liquified low value product, e.g., the nitrogen, can be used to keep vessel 10 cold on the return trip to the liquification facilities, meaning that when liquified argon is again on-loaded into tank 10, there will be minimal loss due to vaporization because vessel 10 will already be at a temperature below or at least very close to the boiling point of the liquified argon. The apparatus and method of the present invention can also be used to cool down the vessel, e.g., vessel 10, used to carry the high value product prior to and during the filing operation with the liquified high value product should that vessel be at ambient or higher temperature. Once again, this minimizes the quantity of liquid argon lost when fling the vessel for shipment.

Although not shown, it will be appreciated that the apparatus of the present invention would form part of a tank truck, railway tank car, shipping barge, or other waterborne shipping craft commonly used to transport liquified low boiling gases. In particular, the present invention is particularly adaptable to tank trucks and railway tank cars, which are most frequently used to ship liquified gases from a first location, e.g., the facility at which the liquified gas is obtained or produced, to a second location, e.g., the location at which the liquified gas is used.

Lastly, it will be appreciated that existing tank cars, railcars, and the like can be easily retrofitted in accordance with the present invention such that minimal capital cost is involved. On new shipping containers, the minimal cost of adding pressure vessel 18 and its associated piping and valving is quickly recouped or offset by the reduced loss of liquified argon during shipping.

The foregoing description and examples illustrate selected embodiments of the present invention. In light thereof, variations and modifications will be suggested to one skilled in the art, all of which are in the spirit and purview of this invention.

What is claimed is:

1. A containment apparatus for the shipping a high value liquified gas product using a liquified gas product having a lower value relative to said high value product, comprising:

a first housing defining a first chamber for said high value liquified gas product, said high value product having a boiling point lower than about −170° C., a second housing defining a second chamber for said low value liquified gas product having a boiling point lower than the boiling point of said high value product, said second housing being disposed within said first housing so as to be at least partially in heat exchange relationship with said high value product;

a first inlet for introducing high value product into said first chamber;

a second inlet for introducing low value product into said second chamber; and a vent for releasing vaporized low value product from said second chamber in response to an increase in temperature in said high value product.

2. The apparatus of claim 1 wherein said vent is selectively operable to release said vaporized low value product.

3. The apparatus of claim 2, further including a controller, said controller having a sensor for detecting a temperature increase in said high value product, said controller being operatively connected to said vent to selectively release vaporized low value product in response to a predetermined increase in temperature in said high value liquified product.

4. The apparatus of claim 1 wherein said vent is operable to release vaporized low value product at atmospheric pressure.

5. The apparatus of claim 1 wherein said vent includes a pressure relief device.

6. The apparatus of claim 1 wherein said first housing is insulated.

7. The apparatus of claim 6 wherein said first housing is encapsulated in and spaced from an outer shell, the space between said outer shell and said first housing being under vacuum.

8. The apparatus of claim 7 wherein said space between said outer shell and said first housing includes a thermal insulating material.

9. The apparatus of claim 1 wherein, and said second housing is positioned in said first housing so as to be substantially immersed in said liquid phase when said high value product is present in said first chamber at a desired filled position.

10. A system for transporting a high value liquified gas product using a liquified gas product having a low value relative to said high value liquified product, comprising:

a first vessel defining a first chamber, said first chamber having a majority of its volume occupied by a high value liquified gas product having a boiling point of lower than about −170° C.;

a second vessel defining a second chamber for containing said low value liquified product, said low value liquified product having a boiling point lower than the boiling point of said high value product, said second chamber being at least partially in heat exchange relationship with said high value liquified high product in said first chamber;

a vent for releasing vaporized low value liquified product in response to an increase in temperature of said high value liquified product; and said second chamber being sized to contain an amount of said low value product to permit sufficient vaporization and venting of said low value product so as to maintain a substantially constant volume of said high value liquified product for a predetermined period of time.

11. The system of claim 10 wherein said vent is selectively operable to relieve said vaporized low value product.

12. The system of claim 11, further including a controller, said controller having a sensor for sensing a temperature increase in said high value product, said controller being operatively connected to said vent to selectively release vaporized low value product in response to a predetermined increase in temperature in said high value liquified product.

13. A method of transporting a high value liquified gas product using a liquified gas product having a lower value relative to said high value product, comprising:

providing a transportable containment apparatus comprising a first housing defining a first chamber for holding high value liquified gas product having a boiling point of less than about −170° C. and a second vessel defining a second chamber for containing said low value liquified product, said low value product having a boiling point lower than the boiling point of said high value product;

introducing liquified high value product into said first chamber to a desired, filled amount, said second chamber being at least partially in heat exchange relationship with said high value liquified product in said first chamber;

releasing vaporized low value liquified product in response to an increase in temperature of said high value liquified product; and transporting said containment apparatus from a first location to a second location.

14. The method of claim 13 wherein said second chamber being sized to contain an amount of said low value product to permit sufficient vaporization and venting of said low value product so as to maintain a substantially constant volume of said high value liquified product for a predetermined period of time.

15. The method of claim 13 wherein said high value liquified product comprises liquified argon.

16. The method of claim 14 wherein said low value liquified product comprises nitrogen.

17. The method of claim 13 wherein said releasing of said vaporized low value product is conducted selectively.

18. The method of claim 13 wherein said releasing is conducted at atmospheric pressure.

* * * * *